US007162992B2

(12) United States Patent
Kobayashi et al.

(10) Patent No.: US 7,162,992 B2
(45) Date of Patent: Jan. 16, 2007

(54) AIR INTAKE DEVICE FOR STRADDLE-TYPE VEHICLE

(75) Inventors: Yasutaka Kobayashi, Akashi (JP); Kohei Kuyama, Kobe (JP); Kiyohito Takano, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 11/114,135

(22) Filed: Apr. 26, 2005

(65) Prior Publication Data

US 2005/0241609 A1 Nov. 3, 2005

(30) Foreign Application Priority Data

Apr. 30, 2004 (JP) ..... 2004-135953

(51) Int. Cl.
*F02B 77/04* (2006.01)
*F02B 77/00* (2006.01)

(52) U.S. Cl. ..... 123/198 E; 123/195 C

(58) Field of Classification Search ..... 123/195 C, 123/198 E

See application file for complete search history.

(56) References Cited

U.S. PATENT DOCUMENTS 2,766,845 A * 10/1956 Raymond ..... 55/312
4,242,951 A * 1/1981 Bemiss ..... 454/146

FOREIGN PATENT DOCUMENTS

JP A 2001-221113 8/2001

* cited by examiner

*Primary Examiner*—Noah P. Kamen
(74) *Attorney, Agent, or Firm*—Oliff & Berridge, PLC

(57) ABSTRACT

The present air intake device for a straddle-type vehicle, includes: an air cleaner case including an outer wall having an outer surface; and an air intake case of a fixed volume having an open end. The open end is disposed opposite to the outer surface of the outer wall so that a predetermined gap is formed between the open end of the air intake case and the outer surface of the outer wall. Thereby, an air intake chamber is formed in the air intake case and the gap forms an air intake inlet. The air intake chamber communicates with an air inlet of an apparatus mounted on the vehicle.

3 Claims, 10 Drawing Sheets

AIR INTAKE DEVICE FOR STRADDLE-TYPE VEHICLE

CROSS REFERENCE TO RELATED APPLICATIONS

This application is based upon and claims the benefit of priority from the prior Japanese Patent Application No. 2004-135953, filed on Apr. 30, 2004, the entire contents of which are incorporated herein by reference.

BACKGROUND OF THE INVENTION

1. Field of the Invention

The present invention relates to an air intake device for a straddle-type vehicle such as a straddle-type four-wheel vehicle or a motorcycle.

2. Description of the Related Art

A straddle-type vehicle is provided with some apparatuses which utilize intake air taken from ambient air. A typical example of this kind of apparatuses is an air cleaner which takes in air for burning in an engine. Other examples are a cooling apparatus which takes in cooling air for a transmission and a breather apparatus for a crank case, etc. All of these apparatuses are provided with air intake portions, respectively.

FIG. 10 shows a known straddle-type four-wheel vehicle having an air intake device (JP-A 2001-221113). The four-wheel vehicle includes a body frame 101 which is provided with a pair of left-and-right front wheels 102 and a pair of left-and-right rear wheels 103. An engine 105 is disposed between the front and rear wheels. A carburetor 116 is disposed above the engine 105 and a air cleaner case 121 of an air cleaner 120 is disposed above the carburetor 116. An air intake duct 118 is mounted on the front end of the air cleaner case 121. The air cleaner case 121 and the carburetor 116 are covered with side covers 113 at their left-and-right sides. The upper part of the air cleaner case 121 is covered with a decorative cover 115. Fenders 110, 111 are disposed above the front and rear wheels 102, 103, respectively. A seat 108 is disposed behind the cleaner case 121. A steering shaft 107 having a steering handlebar 106 at the upper end thereof is disposed in front of the cleaner case 121.

A transit chamber 126 for air intake, which is covered with a front cover 119, is formed above the steering shaft 107. An air intake duct 118 connected to the air cleaner case 121 is extending frontward and upward to the transit chamber 126 so that the upper end of the air intake duct 118 opens in the transit chamber 126.

When ambient air is taken-in in a straddle-type vehicle, an air intake port is preferably disposed at a position as high as possible to prevent water and mud from entering the air intake port. Moreover, the air intake port is preferably covered with a covering member for protection against dust. Accordingly, the air intake duct 118 is extended upward as high as possible, and the upper end thereof opens in the transit chamber 126 which is covered with the front cover 119.

A V-belt continuously variable transmission, not shown, is mounted on the right side of the engine 105. A cooling air intake duct of the transmission is extending upward in front of the engine 105 to the transit chamber 126 so as to open in the transit chamber 126.

FIG. 11 shows another known related art in which an air intake duct 201 of an air cleaner is extended upward and the open upper end of the air intake duct 201 is covered with a cup-shaped cover 202.

In the constitution shown in FIG. 10, a space for disposing the upward extending air intake duct 118 and a space for forming the transit chamber 126 are required so that the size of the vehicle inevitably becomes large and also the number of parts for the air intake device inevitably becomes large.

The constitution shown in FIG. 11 also requires a space for disposing the long air intake duct 201 extending upward. Moreover, an annular air intake port 203 is formed between the outer circumferential surface of the air intake duct 201 and the inner circumferential surface of the cup-shaped cover 202, and the diameter of the air intake duct 201 is limited. Therefore, in order to enlarge the area of the annular air intake port 203, the size of the cup-shaped cover 202 should be enlarged so that the weight of the air intake device inevitably increases.

SUMMARY OF THE INVENTION

Accordingly, it is an object of the present invention to provide an air intake device capable of being contained in a vehicle in a compact manner and of being constituted with a small number of parts.

The present invention provides an air intake device for a straddle-type vehicle, includes: an air cleaner case including an outer wall having an outer surface; and an air intake case of a fixed volume having an open end. The open end is disposed opposite to the outer surface of the outer wall so that a predetermined gap is formed between the open end of the air intake case and the outer surface of the outer wall. Thereby, an air intake chamber is formed in the air intake case and the gap forms an air intake inlet of the air intake chamber. The air intake chamber communicates with an air inlet of an apparatus mounted on the vehicle.

According to the present invention, since the air intake chamber is formed by the air intake case with the open end and the outer surface of the outer wall of the air cleaner case so that the air intake chamber is adjacent to the air cleaner case, the essential part to constitute the air intake device is only the air intake case. Accordingly, the number of parts to manufacture the air intake device can be decreased and the air intake device can be compactly constituted in a free space around the air cleaner case. Moreover, an additional transit chamber, which is necessary for the constitution of related art shown in FIG. 10, are not needed. Furthermore, when the air intake device is used to take in air for an air cleaner, an air intake duct is not needed so that there is no noise generated by air passing through a long intake duct. Noise spreading outside can be reduced by shutting out operational sounds, which are generated in apparatuses disposed at a downstream side with respect to the air cleaner, at the air inlet of the air cleaner. Moreover, when the air intake device is used to take in cooling air for a transmission, a duct for cooling air can be shortened, and pipes for air intake can be simplified to be compact.

Moreover, according to the present invention, since the air intake inlet is formed by the gap between the open end of the air intake case and the outer wall of the air cleaner case, water and mud are prevented from entering the air intake inlet by decreasing the gap. Moreover, since the circumferential length of the open end of the air intake case can be set long, the entire passage area of the air intake inlet can be set large even if the gap is set small, so that an ample amount of air can be taken in.

In the air intake device according to the present invention, it is preferable that the apparatus mounted on the vehicle is an air cleaner of an engine for the vehicle, and the air inlet communicating with the air intake chamber is an air inlet of the air cleaner.

In the air intake device according to the present invention, it is preferable that the apparatus mounted on the vehicle is a V-belt continuously variable transmission for the vehicle, and the air inlet communicating with the air intake chamber is a cooling air inlet of the transmission.

In the air intake device according to the present invention, it is preferable that the apparatus mounted on the vehicle includes an air cleaner of an engine for the vehicle and a V-belt continuously variable transmission for the vehicle, and the air inlet communicating with the air intake chamber includes an air inlet of the air cleaner and a cooling air inlet of the transmission.

According to the present invention, since both the air inlet of the air cleaner and the cooling air inlet of the transmission are connected to the air intake chamber, piping structures to take in air for a vehicle as a whole can be made compact.

In the air cleaner according to the present invention, it is preferable that the air intake chamber is divided by a partition wall into a first chamber communicating with the air inlet of the air cleaner and a second chamber communicating with the cooling air inlet of the transmission.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

General Construction of Vehicle

Figure 1:
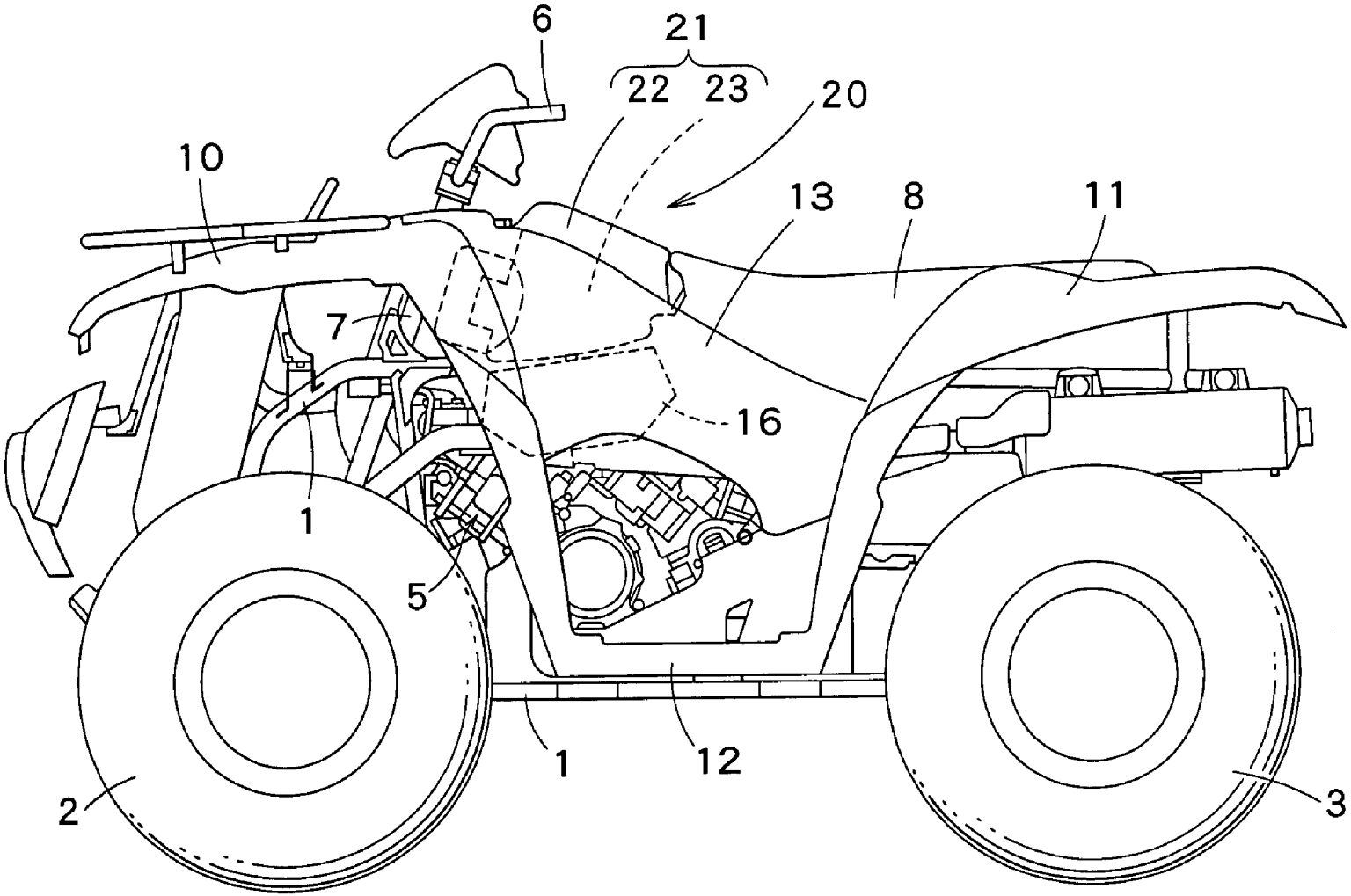
FIG. 1 is a side elevation of a straddle-type four-wheel vehicle provided with an air cleaner in a preferred embodiment according to the present invention taken from the left side of the straddle-type four-wheel vehicle.

Referring to FIG. 1 showing an all-terrain straddle-type four-wheel vehicle provided with an air cleaner 20 in a preferred embodiment according to the present invention, right and left front wheels 2 and right and left rear wheels 3 are suspended from a front part and a rear part, respectively, of a body frame 1, and an engine 5 is supported on the body frame 1 in a space between the front wheels 2 and the rear wheels 3. A steering shaft 7 is disposed in front of the engine 5. A steering handlebar 6 is attached to the upper end of the steering shaft 7. A seat 8 is disposed at an elevated position behind the engine 5. Front fenders 10 and rear fenders 11 are extended over the front wheels 2 and the rear wheels 3, respectively. Foot boards 12 are disposed on the right and the left side, respectively, of the lower end of the engine 5. The right and the left side of an upper part of the engine 5 are covered with side covers 13, respectively.

The engine 5 is a V engine having two banks set at an angle. A carburetor 16 is placed between the two banks. A cleaner case 21 included in the air cleaner 20 is extended in the back-and-forth direction above the carburetor 16 between the steering shaft 7 and the seat 8.

External Construction of Air Cleaner

The cleaner case 21 is formed by joining together an upper case member 22 and a lower case member 23. The lower case member 23 and the carburetor 16 are covered with the right and the left side covers. The upper case member 22 protrudes upward from a plane containing the upper edges of the right and the left side covers 13 so as to be exposed. The upper surface of the upper case member merges smoothly into the upper surface of the seat 8. Thus the upper case member 22 and the seat 8 are decorative components designed to form part of the external shape of the vehicle.

Figure 2:
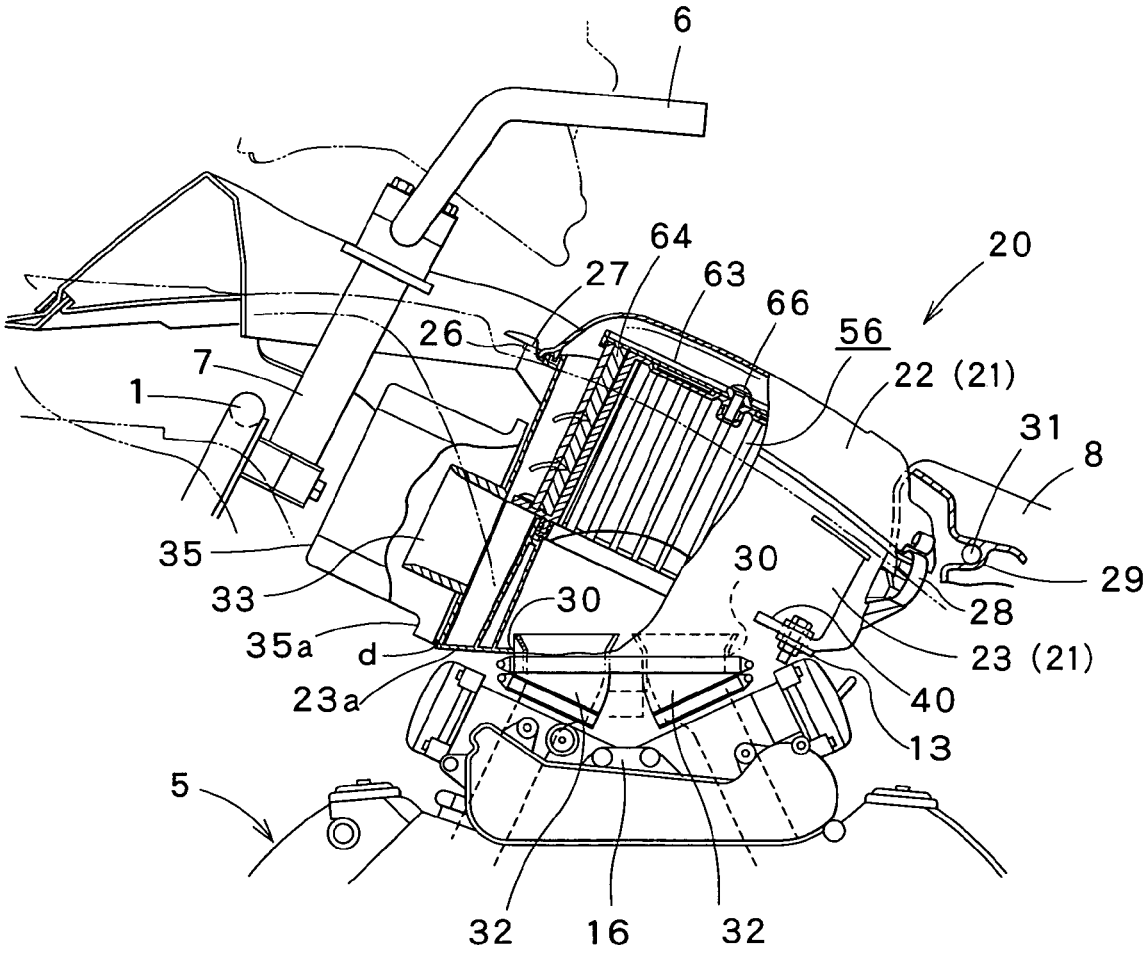
FIG. 2 is a side elevation, partly in vertical section, of the air cleaner shown in FIG. 1 and devices associated with the air cleaner.

Referring to FIG. 2, a filter assembly 56 is held in an upper half part of the lower case member 23. A locking projection 26 is formed integrally with the upper case member 22 so as to project forward from the front end of the upper case member 22. A locking hole 27 is formed in a front end part of the lower case member 23. The locking projection 26 is inserted in the locking hole 27 from behind the locking hole 27. Respective rear end parts of the case members 22 and 23 are separably clamped together with a pair of left and right clamping members 28. A front end part of the seat 8 extends over the upper, the right and the left side of the rear end parts of the case members 22 and 23 clamped by the clamping members 28 so as to cover the rear end parts of the case members 22 and 23 such that the rear end parts of the case members 22 and 23 are concealed from view.

The outward appearance of the vehicle is not ruined even if the upper part of the cleaner case 21 is used as a member constituting a part of the outward appearance of the vehicle since the rear end parts of the case members 22 and 23 and the clamping members 28 are concealed from view by the front end part of the seat 8.

Moreover, operations for attaching and detaching the upper case member 22 is easy since the upper case member 22 is connected to the lower case member 23 by the insertion system including the locking projection 26 and the locking hole 27 at the front end thereof and by the clamping members 28 at the rear end thereof.

The seat is provided with a hook 29 in the front end part thereof. The hook 29 engages with a bar 31 attached to the body frame 1. The rear end part of the seat 8 is releasably locked to the body frame 1 by a locking mechanism, not shown. The seat 8 can be removed from the body frame 1 by releasing the rear end part thereof from the locking mechanism.

In a vertical plane, the lower case member 23 has a trapezoidal shape having a front side of a vertical dimension greater than that of a back side. The lower case member 23 is disposed above the carburetor 16 with its bottom wall 23*a* substantially horizontally extended. Front and rear air outlet ports 30 are formed on the bottom wall 23*a*. The air outlet ports 30 are connected to air intake pipes 32 for the front and the rear cylinder of the engine 5 of the carburetor 16, respectively. An inlet port 33 opening toward the front projects forward from a front, lower part of the lower case member 23. As an air intake device, an air intake case 35 is disposed in front of the cleaner case 21 so as to cover the inlet port 33. The air intake case 35 has an open rear end 35*a* and is formed in the shape of a cup. A gap d is formed between the end surface of the open rear end 35*a* and a part of the outer surface, corresponding to the open rear end 35*a*, of the side wall of the lower case member 23.

Figure 3:
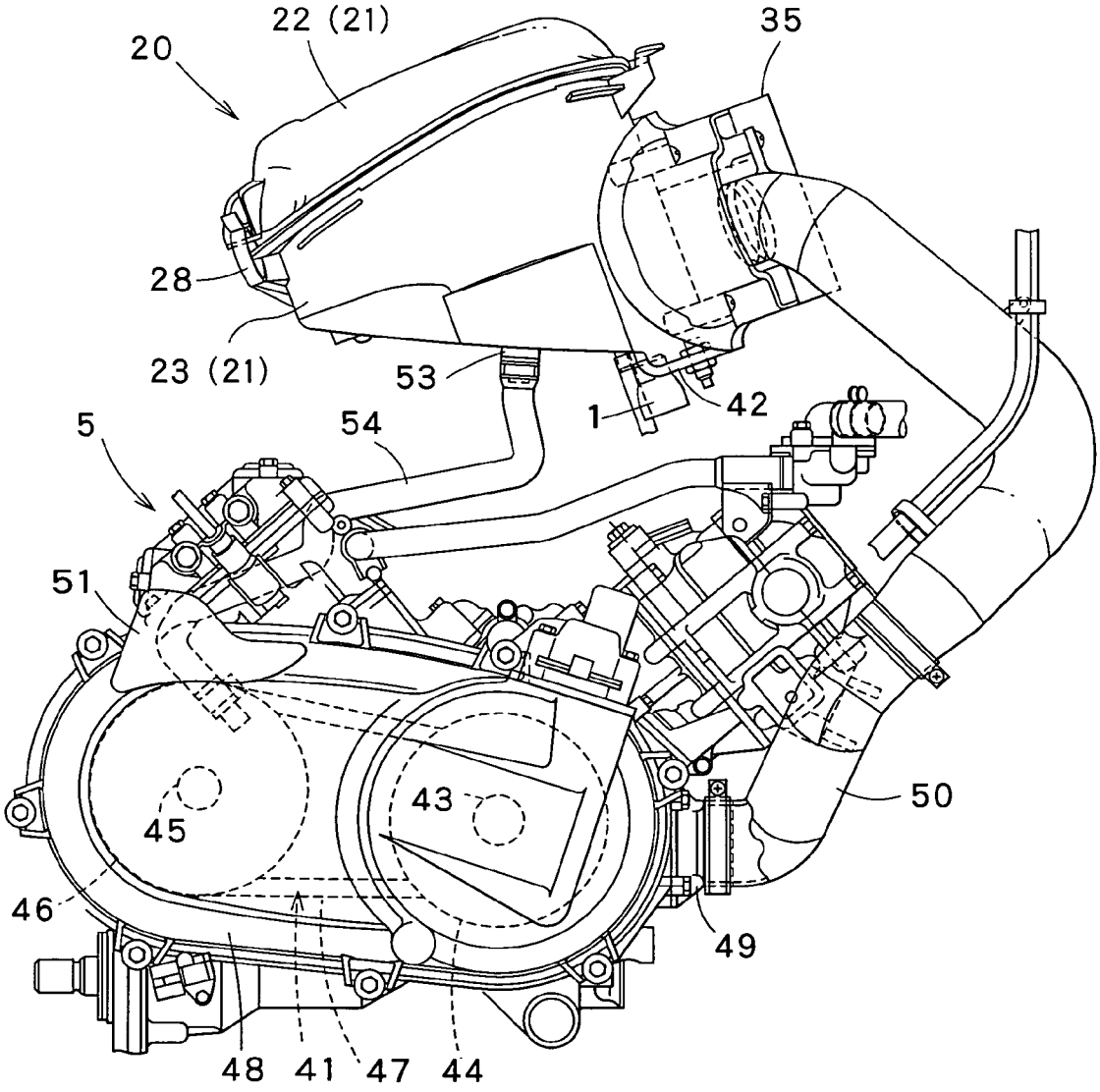
FIG. 3 is a side elevation of an engine and the air cleaner shown in FIG. 1, taken from the right side of the air cleaner.

A bracket 40 formed in, for example, a rear part of the left side surface of the lower case member 23 is fastened to a bracket attached to the side cover 13, and a bracket 42 formed in a front end part of the right side surface of the lower case member 23 is fastened to the body frame 1 as shown in FIG. 3.

Referring to FIG. 3 showing the engine 5 and the air cleaner 20 in a side elevation taken from the right side of the vehicle, a V-belt continuously variable transmission 41 is joined to the right side surface of the engine 5. The transmission 41 includes a drive pulley 44 interlocked with the output shaft 43 of the engine 5, a driven pulley 46 mounted on an input shaft 45 of a gear transmission (not shown), and a V belt 47 extended between the pulleys 44 and 46. The drive pulley 44, the driven pulley 16 and the V belt 47 are covered with a belt cover 48. A cooling air intake port 49 is formed on a front end part of the belt cover 48. The cooling air intake port 49 is connected to the air intake case 35 by an air intake duct 50 for taking in a cooling air. A cooling air discharge port 51 projects upward from a rear end part of the belt cover 48. A breather port 53 projects from the lower surface of the lower case member 23 of the cleaner case 21. The breather port 53 communicates with the interior of the engine 5 by means of a breather pipe 54.

Internal Construction of Air Cleaner

Figure 4:
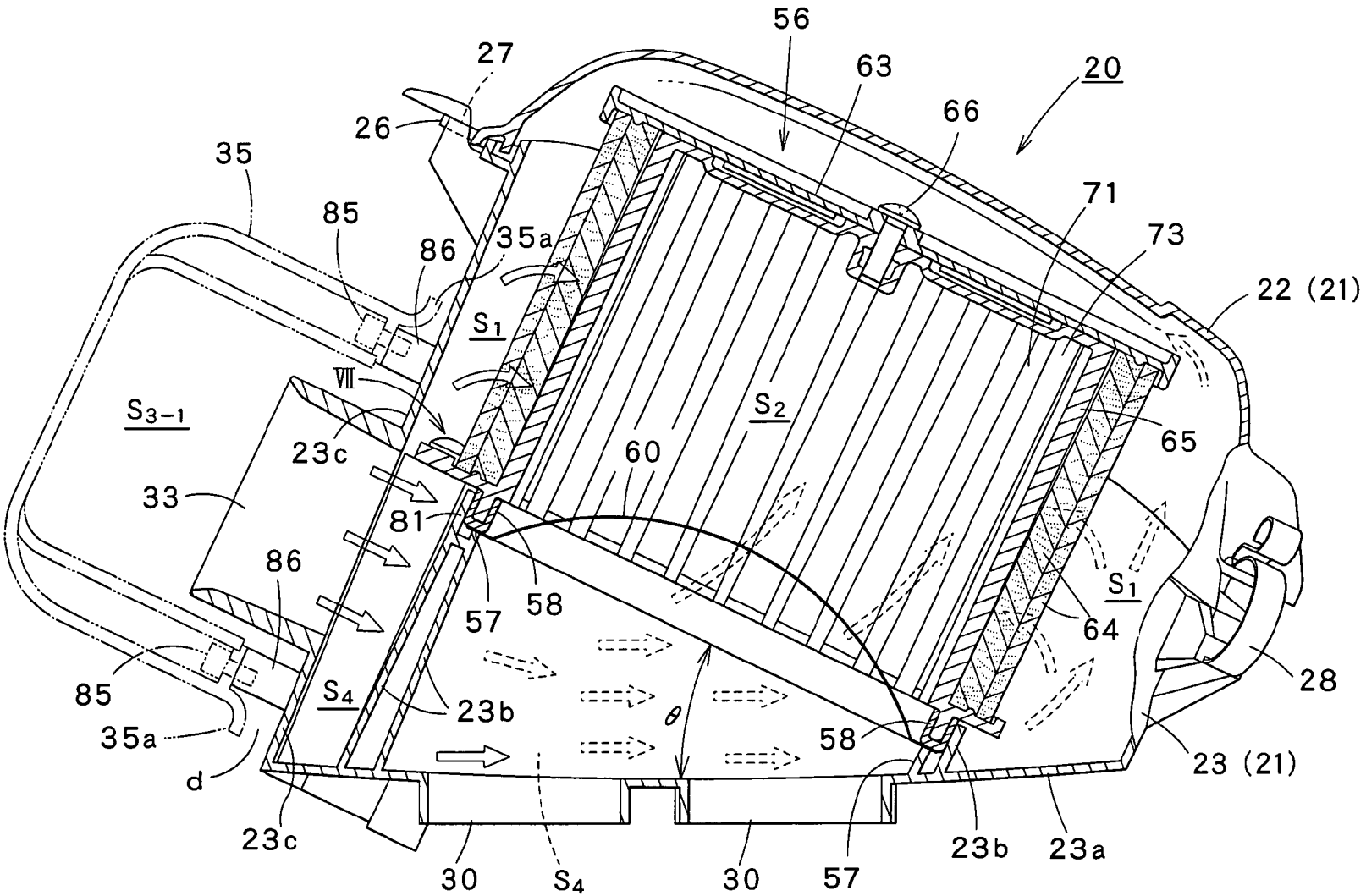
FIG. 4 is an enlarged vertical sectional view of the air cleaner shown in FIG. 1 taken from the left side of the air cleaner.

Referring to FIG. 4 showing the air cleaner 20 in a vertical sectional view taken from the left side, a cylindrical support wall 23*b* is formed integrally with the bottom wall 23*a* of the lower case member 23 so as to rise obliquely upward from the bottom wall 23*a*. An installation seat 57 is formed at the upper end of the support wall 23*b*. The filter assembly 56 is seated on the installation seat 57 through a rubber trim seal 58. A peripheral part of a flame arrester 60 formed from a wire net is held between the installation seat 57 and the trim seal 58. A central part of the flame arrester 60 is formed in an upward convex spherical shape. The cylindrical support wall 23*b* is a double-wall structure rising obliquely backward substantially parallel to the front end surface 23*c* of the lower case member 23*a*. The installation seat 57 formed at the upper end of the support wall 23*b* is inclined at an angle θ to a horizontal plane such that the installation seat 57 slopes down backward. The front end part of the support wall 23*b* is opposed to the inlet port 33 from behind the inlet port 33. The height of a lower air chamber S4 surrounding the support wall 23*b* decreases backward. Thus the distance between the bottom wall 23*b* and the filter assembly 56 decreases backward.

Filter Assembly

Figure 5:
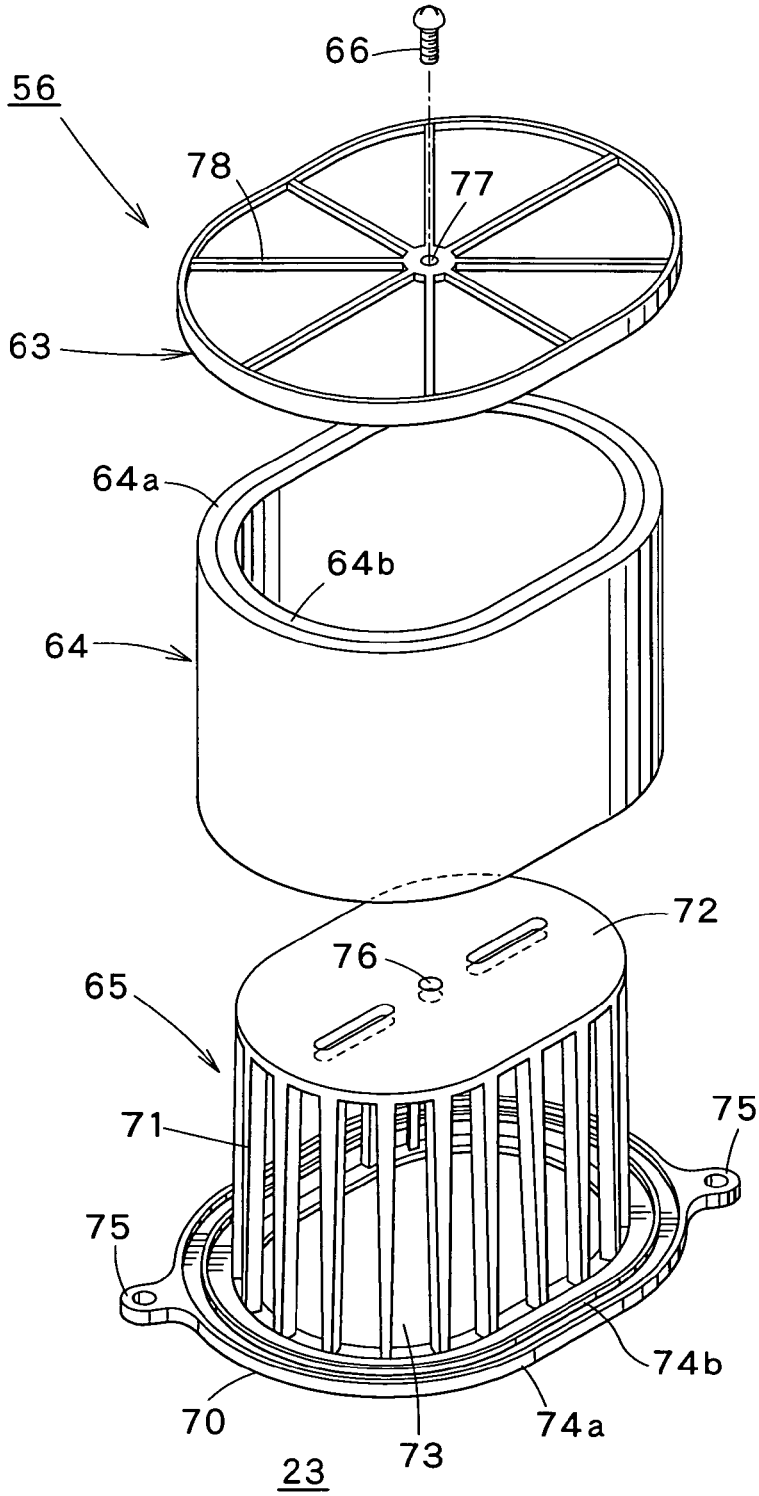
FIG. 5 is an exploded perspective view of a filter assembly included in the air cleaner shown in FIG. 1.

Referring to FIG. 5 showing the filter assembly 56 in an exploded perspective view, the filter assembly 56 includes a cylindrical cleaner element 64 formed from urethane foam sheets, a support frame 65 of a resin, supporting the cleaner element 64 thereon and keeping the cleaner element 64 in a predetermined cylindrical shape, and a flat, resin top cover 63 fastened to the support frame 65 with a bolt 66 to hold the cleaner element 64 in place on the support frame 65. The cleaner element 64 has an oblong shape extending in the back-and-forth direction in a horizontal plane. The cleaner element 64 is a two-layer structure consisting of a coarse outer layer 64*a* and a fine inner layer 64*b*.

The support frame 65 has an annular base 70 on which the cleaner element 64 is supported, a side wall 71 for keeping the cleaner element 64 in the shape of an elliptic cylinder and a top wall 72. The base 70, the side wall 71 and the top wall 72 are formed integrally.

The side wall 71 is a grating. The side wall 71 is provided with a plurality of slit air passages 73 circumferentially arranged at fixed intervals. The slit air passages 73 extend between the base 70 and the top wall 72. The base 70 is provided integrally with ribs 74*a* and 774*b* extending along the outer edge of the base 70 and in a middle part, with respect to the width, of the base 70, respectively, to determined the position of the lower end of the cleaner element 64 on the base 70. The base 70 is provided with a pair of opposite tabs 75. The tabs 75 are fastened to the lower case member 23. A threaded hole 76 is formed in a central part of the top wall 72. The bolt 66 is screwed in the threaded hole 76 to fasten the top cover 63 to the support frame 65.

The top cover 63 is a flat resin plate of an oblong shape corresponding to that of a horizontal section of the cleaner element 64 having a central boss provided with a through hole 77 and radial arms 78 radially extending from the central boss.

Figure 7:
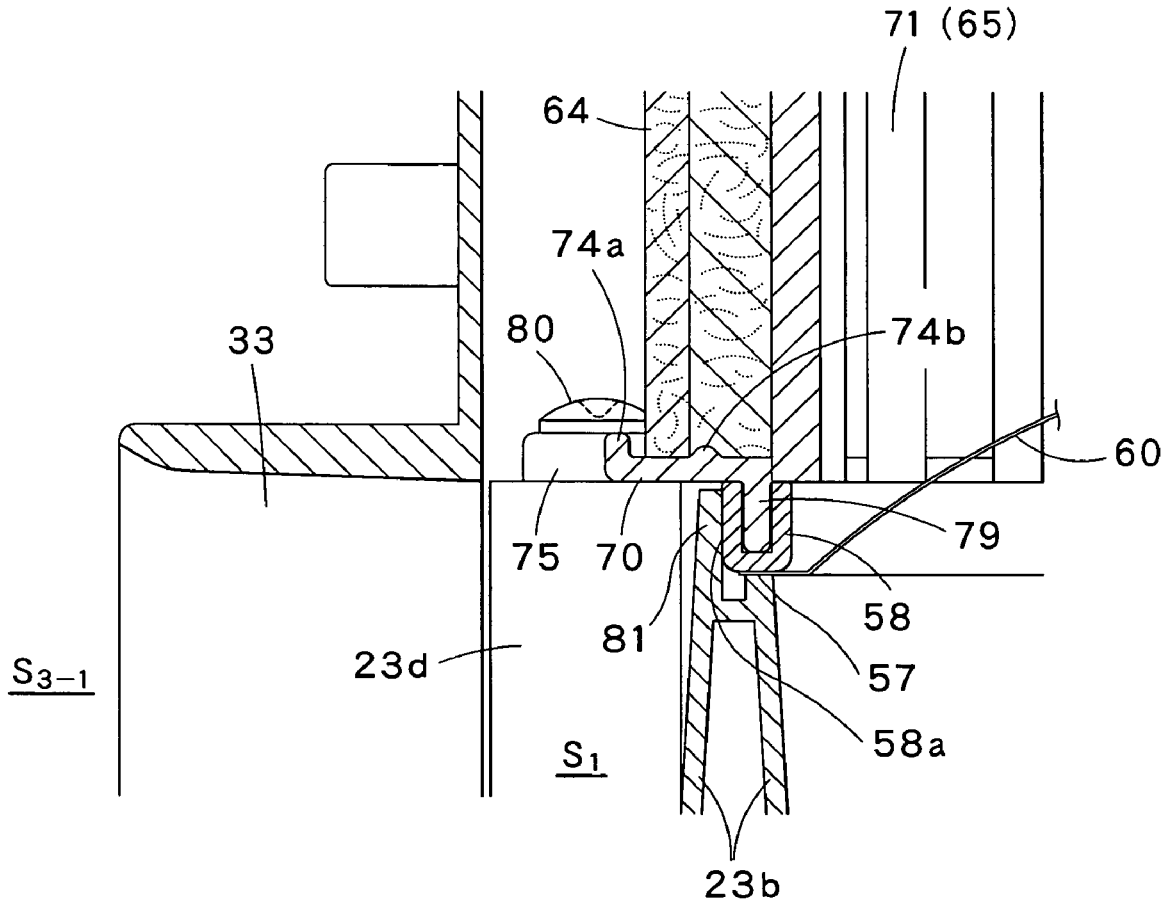
FIG. 7 is an enlarged view of a part indicated by the arrow VII in FIG. 4.

Referring to FIG. 7, the base 70 of the support frame 65 is integrally provided on its lower surface with a downward protruding rib 79 extending along the entire perimeter of the base 70. The rubber trim seal 58 having a U-shaped cross section is put on the rib 79. An upward protruding oblong rib 81 is formed on the radially outer side of the installation seat 57 of the support wall 23*b* along the entire perimeter of the installation seat 57. The rib 81 and the installation seat 57 are spaced apart by an oblong groove.

The base 70 of the support frame 65 is seated on the installation seat 57. The trim seal 58 and the peripheral part of the flame arrester 60 are held between the installation seat 57 and the base 70. The tabs 75 are fastened to the lower case member 23 with bolts 80. The outer side surface of the trim seal 58 is pressed against the inner side surface of the upward protruding oblong rib 81. Thus the trim seal 58 is kept in a predetermined cylindrical shape and is uniformly compressed.

Figure 6:
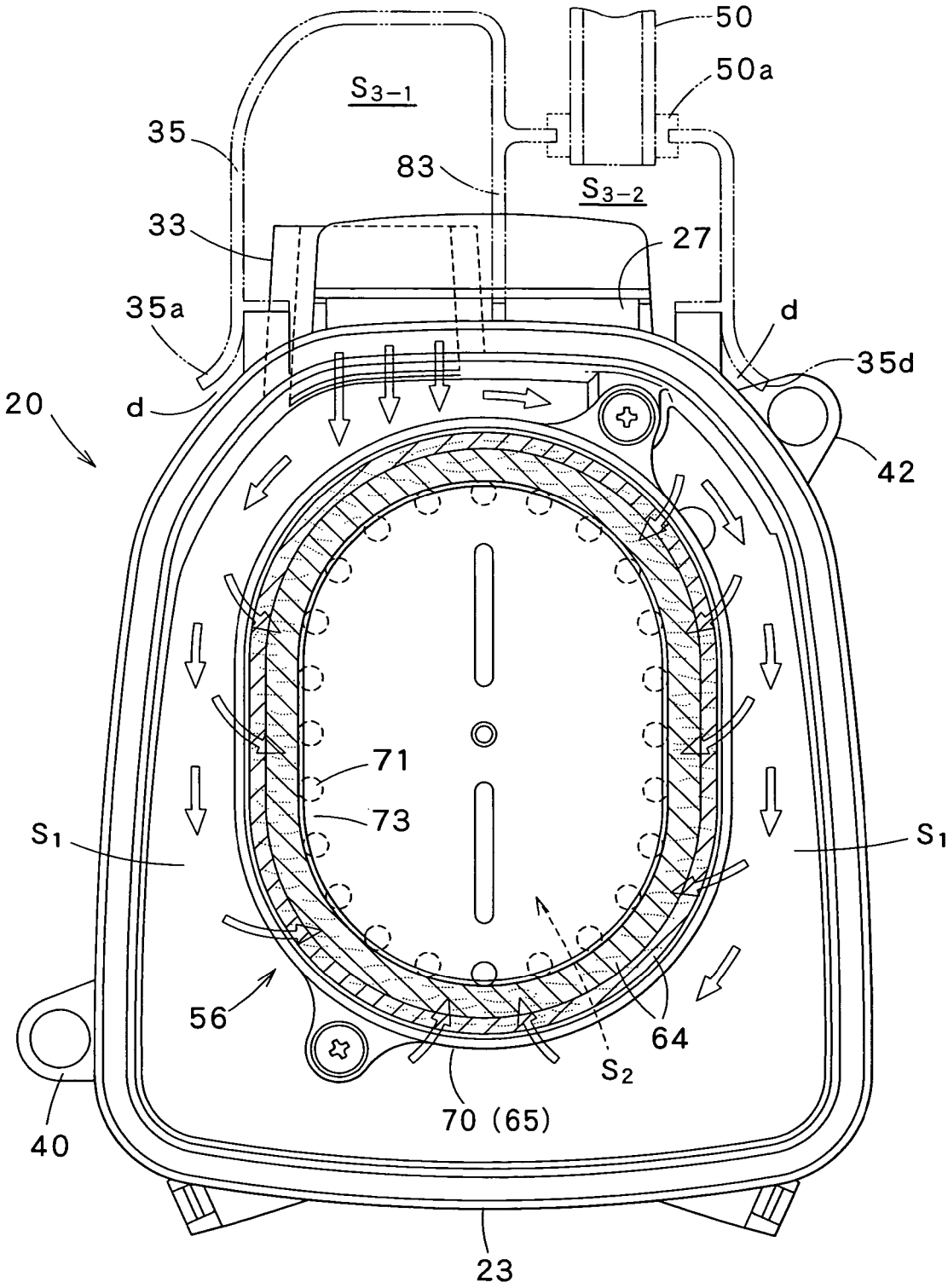
FIG. 6 is a plan view of the air cleaner shown in FIG. 1, in which an upper case member is removed.

FIG. 6 is a plan view of the air cleaner 20, in which the upper case member 22 is removed. An outer air chamber SI, namely, an intake air chamber, is formed around the filter assembly 56 along the entire perimeter of the filter assembly 56 so as to be connected to the lower air chamber 54 shown in FIG. 4. An inner air chamber S2, namely, clean air chamber, is formed in the filter assembly 56.

Constitution of Air Intake Device

Figure 8:
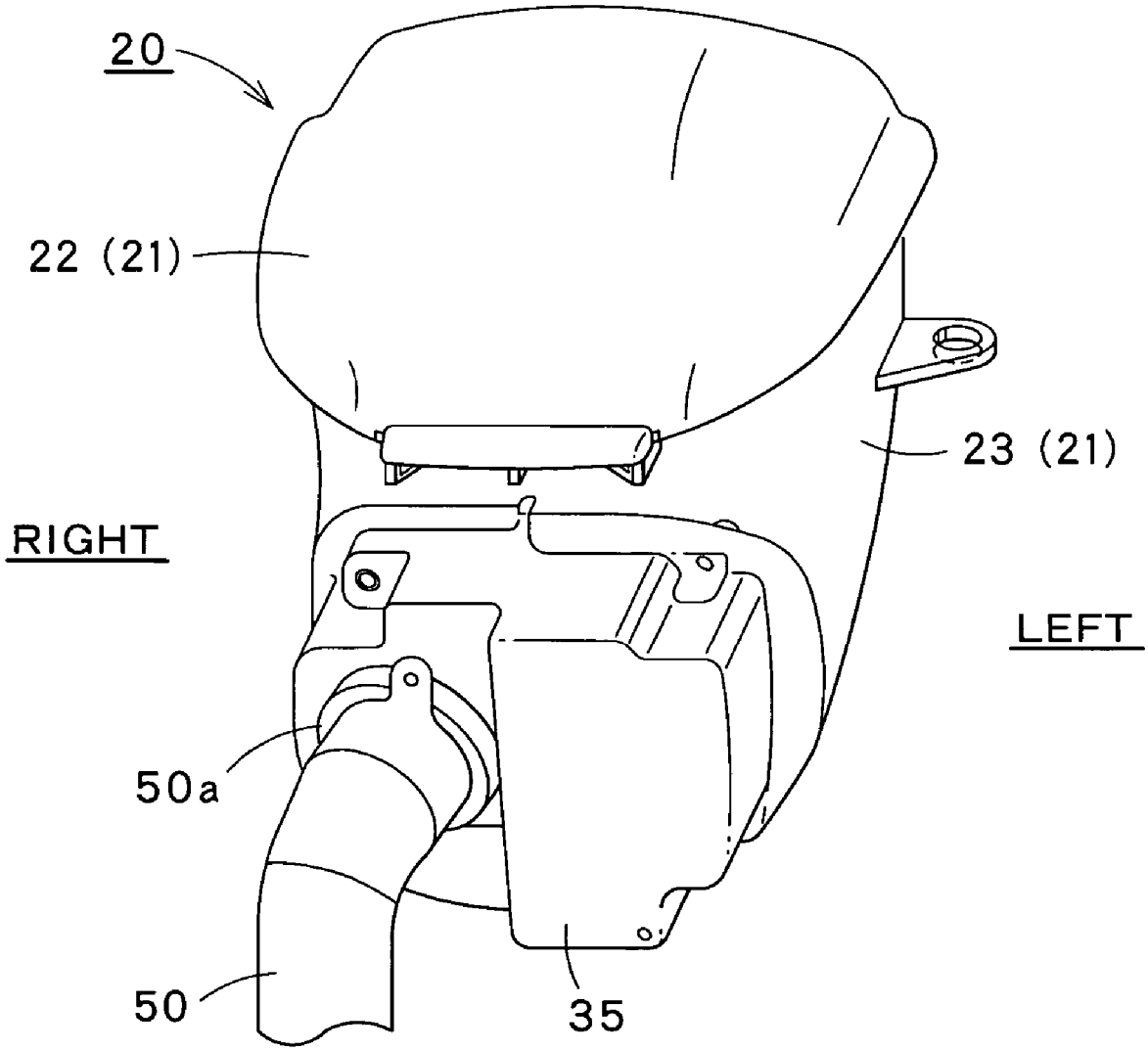
FIG. 8 is a perspective view of the air cleaner shown in FIG. 1.
Figure 9:
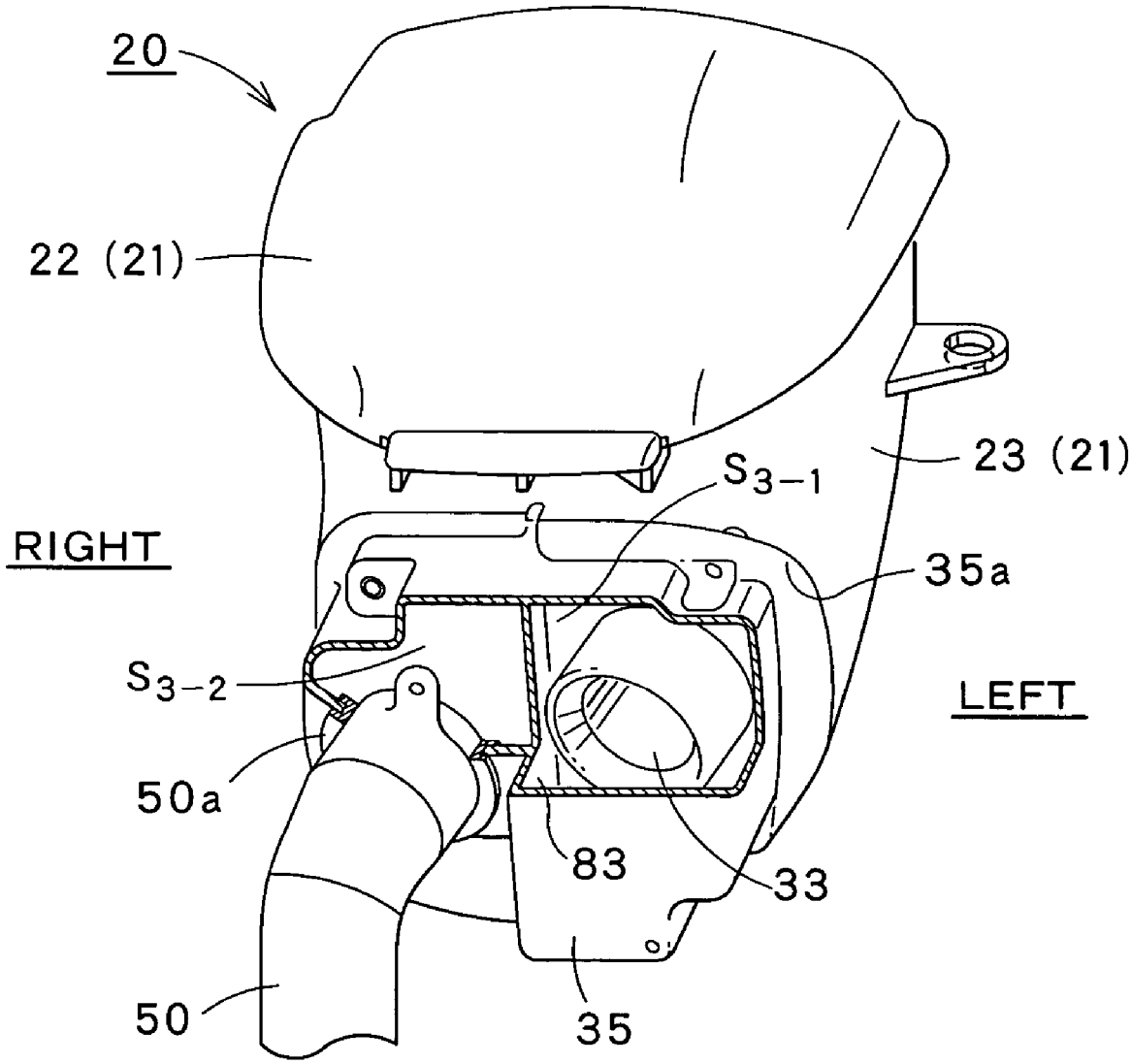
FIG. 9 is a partly cutaway perspective view, similar to FIG. 8, of the air cleaner.
Figure 10:
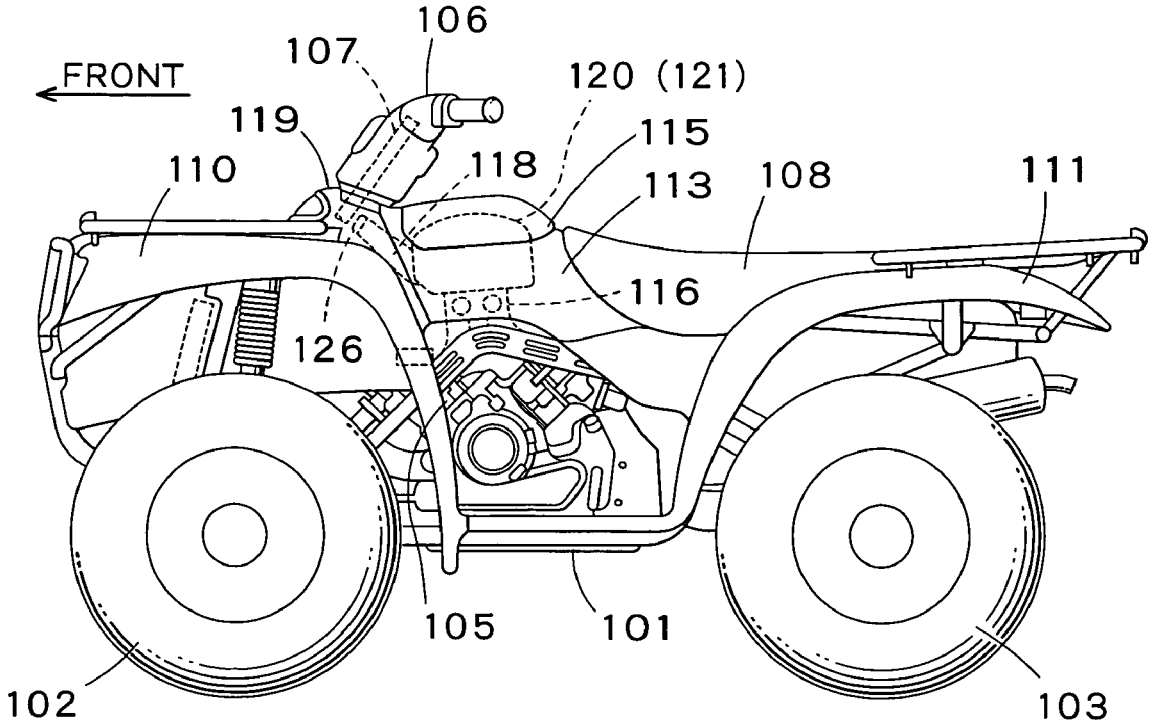
FIG. 10 is a side elevation of a straddle-type four-wheel vehicle provided with an air cleaner of related art.
Figure 11:
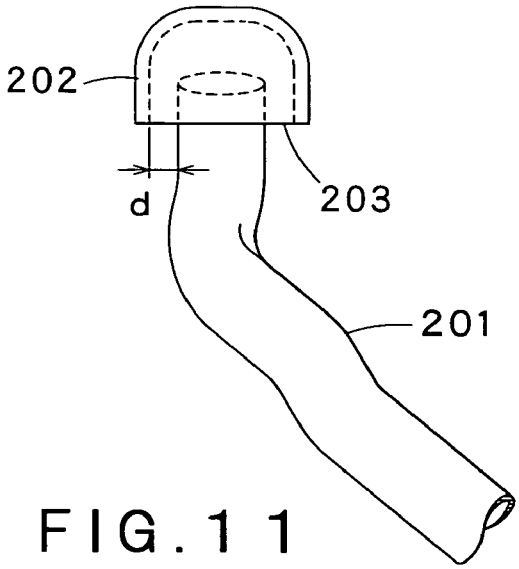
FIG. 11 is a perspective view of an air intake device of another related art.

FIG. 8 is a perspective view of the air cleaner 20 and FIG. 9 is a perspective view of the air cleaner 20 on which an upper front part of the air intake case 35 is cut away. Referring to FIG. 9, the interior of the air intake case 35 as an air intake device is divided into a cooling air chamber S3-2 on the right side of the vehicle and an intake air chamber S3-1 on the left side of the vehicle by a partition wall 83 formed integrally with the intake air case 35. The cooling air duct 50 is connected to the cooling air chamber S3-2 to induce cooling air for cooling the transmission through the cooling air chamber S3-2. The cooling air duct 50 is connected to the air intake case 35 by a rubber sealing ring 50*a*. One part, corresponding to the intake air chamber S3-1, of the front wall of the intake air case 35 lies ahead of a plane containing the other part, corresponding to the cooling air chamber S3-2, of the front wall of the intake air case. The intake air chamber S3-1 has a volume greater than that of the cooling air chamber S3-2. The inlet port 33 of the air cleaner projects into the air intake chamber S3-1.

As shown in FIG. 4, the air intake case 35 is fastened to a boss 86 formed on the lower case member 23 with a plurality of bolts 85. As mentioned above, the gap d is formed between the end surface of the open rear end 35*a* of the air intake case 35 and the outer surface of the side wall of the lower case member 23. Air flows through the gap d into the air intake chamber S3-1 and the cooling air chamber S3-2.

The part of the outer circumferential surface of the cleaner case 21 forming the gap d is not necessarily formed so as to be smoothly connected to the surroundings thereof as shown in FIG. 6. Moreover, the gap d can be formed by a member which is manufactured separately from the cleaner case 21 and is attached to the outer circumferential surface of the cleaner case 21.

Procedure for Changing Cleaner Element (1) Referring to FIG. 2, the locking mechanism, not shown, locking the rear end of the seat 8 is unfastened, the hook 29 is disengaged from the bar 31, and the seat 8 is removed to expose the clamp member 28 clamping the respective rear end parts of the case members 22 and 23. Then, the clamping member 28 is removed, the locking projection 26 formed integrally with the upper case member 22 is extracted from the locking hole 27 formed in the front end part of the lower case member 23, and the upper case member 22 is removed.

(2) The bolt 66 at the center of the top cover 63 is removed, and the resin top cover 63 is taken off. Thus, the cleaner element 64 can be made in a removable state by only removing the plate-shaped resin top cover 63 so that removal operations can be facilitated.

(3) Subsequently, only the cleaner element 64 is removed from the support frame 65 out by pulling up the cleaner element 64 relative to the side wall 71 of the support frame 65. Then, a new cleaner element 64 is put on the side wall 71 of the support frame 65.

(4) The top cover 63 is put on the top wall 72 of the support frame 65 and is fastened to the top wall 72 with the bolt 66 to press the upper and the lower end of the cleaner element 64 against the top cover 63 and the base 70.

Change of Flame Arrester

A peripheral part of the flame arrester 60 is held between the base 70 of the support frame 65 and the installation seat 57 of the support wall 23*b*. The flame arrester 60 can be replaced with a new one after removing the support frame 65 from the lower case member 23. Since only the flame arrester 60 can be changed, cost of parts can be saved.

Air Flow in Air Cleaner (1) Referring to FIG. 4, air flows through the gap d between the end surface of the open rear end 35*a* of the air intake case 35 and the outer surface of the side wall of the lower case member 23 into the intake air chamber S3-1 and the cooling air chamber S3-2. Since air is thus taken into the air cleaner 20 through the gap d, entrance of water and mud into the air cleaner 20 can be prevented. Since the gap d corresponds to the entire perimeter of the open rear end 35*a* of the air intake case 35, sufficient air is able to flow into the air cleaner 20 even when the gap d is decreased.

(2) Air flowed into the intake air chamber S3-1 flows through the inlet port 33 into the lower air chamber S4 of the cleaner case 21 and impinges on the front end of the support wall 23*b* immediately after flowing into the lower air chamber S4. Consequently, water and mud contained in the induced air can be separated from air.

(3) Then, the induced air flows smoothly rearward along the right and the left surfaces of the support wall 23*b* in the lower air chamber S4 because the flowing direction of the induced air is not changed sharply. Then, the induced air flows gradually into the outer air chamber SI surrounding the filter assembly 56 as the induced air flows rearward in the lower air chamber S4. Thus the induced air is distributed over the outer surface of the filter assembly 56. Part of the induced air flows in a tumbling flow from an upper region above the filter assembly 56 into a front region in front of the filter assembly.

(4) Referring to FIG. 6, as the induced air flows through all parts of the cleaner element 64 of the filter assembly 56 into the inner air chamber S2, the cleaner element 64 filters the induced air. The filtered, induced air flows through the outlet ports 30 (FIG. 2) formed on the bottom wall 23*a* into the intake pipes 32 of the carburetor.

(5) The induced air flowed into the cooling air chamber S3-2 flows through the cooling air duct 50 into the space covered with the belt cover 48 to cool the transmission 41. The induced air cooled the transmission 41 is discharged outside through the discharge port 51. Since the cooling air chamber S3-2 is separated from the intake air chamber S3-1 by the partition wall 83, the intake air for the engine and the cooling air do not interfere with each other so that both of the induced air can be used free of turbulence caused by the other.

The inlet port of the air cleaner may be disposed on the left or right side of the air cleaner, or the rear side of the same, so that the intake air chamber is disposed at the cleaner inlet port thus disposed.

Only either the cleaner inlet port of the air cleaner or the cooling air duct for the transmission may be connected to the air intake case. Or, the breather pipe 54 (FIG. 3) of the breather apparatus for the crank case may be connected to the air intake case. Moreover, ducts or pipes for cooling air for the other apparatuses may be connected to the air intake case.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. An air intake device for a straddle-type vehicle comprising:

an air cleaner case including an outer wall having an outer surface;

an air intake case of a fixed volume having an open end, the open end being disposed opposite to the outer surface of the outer wall so that a predetermined gap is formed between the open end of the air intake case and the outer surface of the outer wall, an air intake chamber is formed in the air intake case and the gap forms an air intake inlet of the air intake chamber, wherein the air intake chamber allows air to flow from the air intake chamber to an air inlet of an apparatus mounted on the vehicle;

wherein the apparatus mounted on the vehicle is a V-belt continuously variable transmission for the vehicle, and the air inlet communicating with the air intake chamber is a cooling air inlet of the transmission.

2. An air intake device for a straddle-type vehicle comprising:

an air cleaner case including an outer wall having an outer surface;

an air intake case of a fixed volume having an open end, the open end being disposed opposite to the outer surface of the outer wall so that a predetermined gap is formed between the open end of the air intake case and the outer surface of the outer wall, an air intake chamber is formed in the air intake case and the gap forms an air intake inlet of the air intake chamber, wherein the air intake chamber allows air to flow from the air intake chamber to an air inlet of an apparatus mounted on the vehicle;

wherein the apparatus mounted on the vehicle includes an air cleaner of an engine and a V-belt continuously variable transmission for the vehicle, and the air inlet communicating with the air intake chamber includes an air inlet of the air cleaner and a cooling air inlet of the transmission.

3. The air intake device according to claim 2, wherein the air intake chamber is divided by a partition wall into a first chamber communicating with the air inlet of the air cleaner and a second chamber communicating with the cooling air inlet of the transmission.

* * * * *